United States Patent [19]

Pai

[11] 4,204,202

[45] May 20, 1980

[54] SECURITY ATTACHE CASE WITH AUTOMATIC ALARM SYSTEM

[76] Inventor: George C. Pai, No. 23, Lane 76, An-Ho Rd., Taipei, Taiwan

[21] Appl. No.: 924,444

[22] Filed: Jul. 13, 1978

[51] Int. Cl.[2] ..... G08B 13/14

[52] U.S. Cl. ..... 340/571; 340/689

[58] Field of Search ..... 340/571, 686, 689; 190/60, 42

[56] References Cited

U.S. PATENT DOCUMENTS

| | | | |
|---|---|---|---|
| 919,385 | 4/1909 | Ruthven | 340/571 |
| 2,038,625 | 4/1936 | Adler | 340/571 |
| 2,927,311 | 3/1960 | Donaldson | 340/571 |
| 4,117,468 | 9/1978 | Va'squez | 340/571 |
| 4,155,079 | 5/1979 | Chiu et al. | 340/686 |

*Primary Examiner*—Glen R. Swann, III

[57] ABSTRACT

An attache case with a built-in alarm circuit does not differ in external appearance from a conventional attache case. It has a handle fastened to the body by two sets of metal studs and two locks. The alarm circuit is controlled by a pair of silicon controlled switches connected, respectively, between a first lock and a first set of studs and between the first lock and the second set of studs. Setting the case in a vertical or horizontal position and simultaneously touching the first lock and first set of studs operates the first silicon controlled switch to arm the alarm circuit, which will be actuated by a gravity switch if the case is subsequently moved. Simultaneously touching the first lock and the second set of studs operates the second silicon controlled switch to actuate the alarm instantly. The other lock is used as an on/off switch for the alarm system.

4 Claims, 4 Drawing Figures

SECURITY ATTACHE CASE WITH AUTOMATIC ALARM SYSTEM

BACKGROUND OF THE INVENTION

1. Field of the Invention

This invention relates to an improved attache case, especially to an electronic alarm circuit thereof.

2. Brief Description of the Prior Art

Conventional attache cases are usually not equipped with alarm generating means for preventing the same from being stolen.

Recently, there has been developed a kind of attache case which comprises a chain made of metal or leather to link the case with the wrist of the user.

Another kind of conventional attache cases have alarm apparatus for generating sound or smoke signals when the cases are being robbed or stolen. Such kind of cases are always equipped with special keys for resetting the alarm, it is therefore inconvenient for the users to carry the keys with them. Besides, the resetting operation by using keys is complicated.

BRIEF SUMMARY OF THE INVENTION

The primary object of the present invention is to provide an attache case which is identical to the conventional one in the outer apperaance.

Another object of the invention is to provide the attache case with an improved electronic alarm circuit which can be set from the outside of the case and will generate a sound alarm when the case is being stolen. The alarm circuit has multiple trigger points for starting the alarm.

A further object of the invention is to provide the attache case with an inside container for collecting small pieces of articles and for containing the electronic components of the alarm circuit.

Those and other objects and advantages will become apparent from the following detailed description of the preferred embodiment with reference to the accompanying drawings.

DETAILED DESCRIPTION OF THE PREFERRED EMBODIMENT

Figure 1:
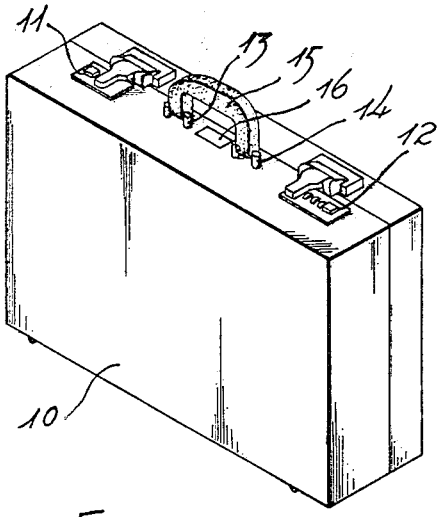
FIG. 1 is a perspective view of the attache case according to the present invention.

Referring to FIG. 1 which shows a perspective view of the attache case according to the present invention. The case is similar to a conventional attache case in its outer appearance, and comprises a case body 10, two locks 11, 12, and a handle 15 which is connected to the case body 10 through pairs of metal studs 13 and 14. On the surface between the metal studs 13 and 14 of the case body 10, there is provided a name plate 16 which is usually made of metal material. A conducting wire connects the name plate 16 to the metal studs 14.

Figure 2:
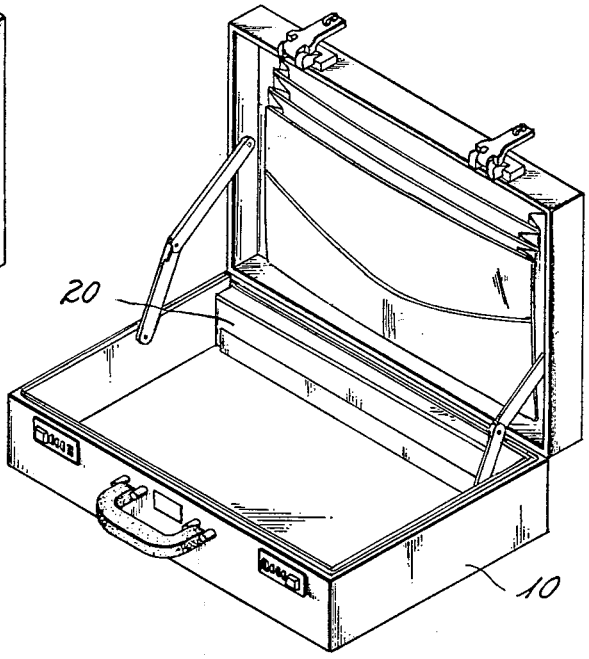
FIG. 2 is a perspective view of the attache case according to the present invention showing the inside container thereof.
Figure 3:
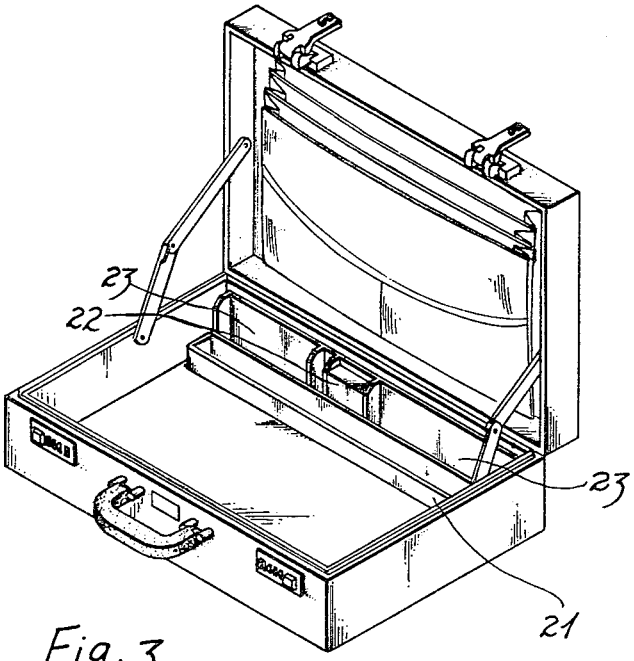
FIG. 3 is a perspective view of the attache case showing the inside container at an opened state.

Referring to FIG. 2 with reference to FIG. 3, the attache case according to the present invention comprises an inside container 20 fixed to the bottom of the case body 10. The inside container 20 further comprises a cover 21; a plurality of properly divided chambers 23 for collecting the small articles, especially for fragile things such as glasses, mini calculator and cigarettes; and a closed chamber 22 with the electronic components of the alarm circuit situated therein.

Figure 4:
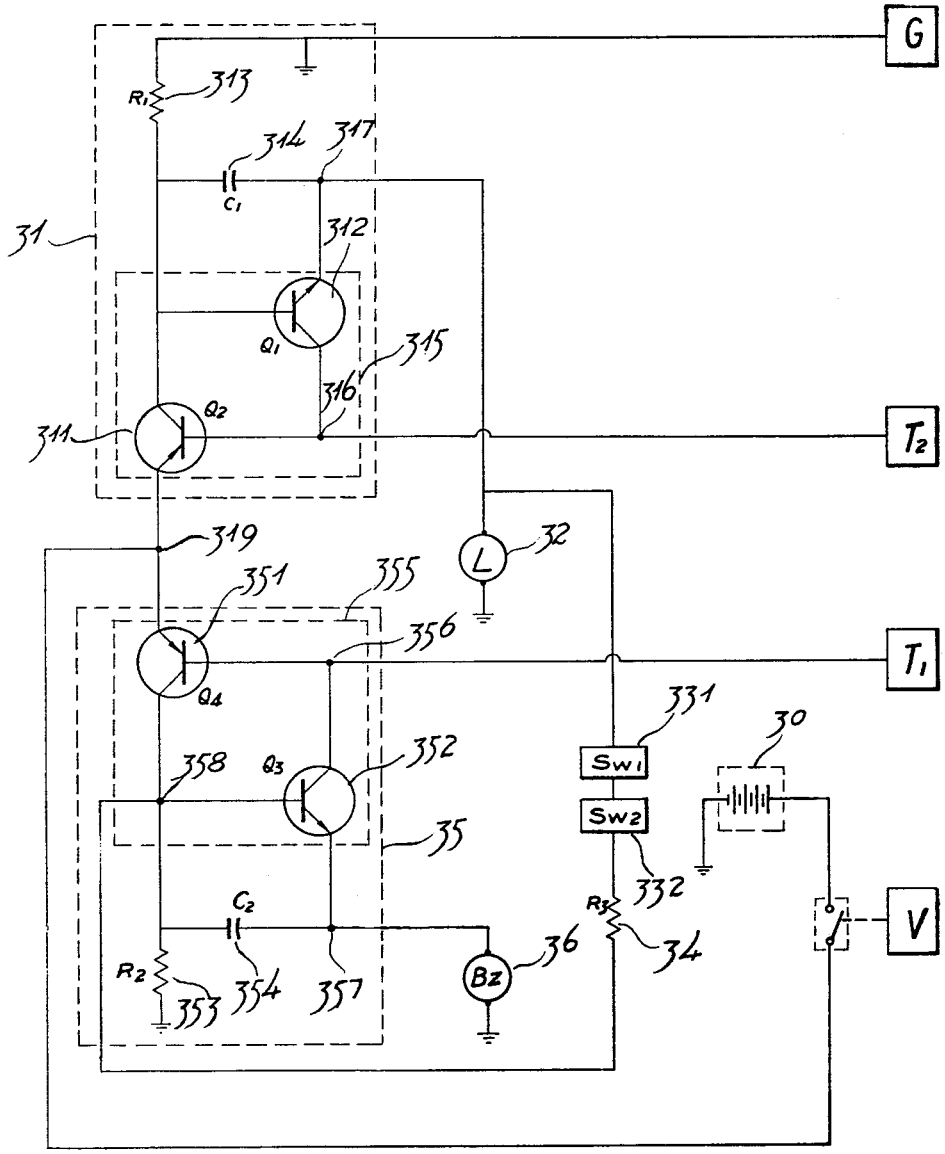
FIG. 4 is an electric circuit diagram of the alarm used for the present invention.

Referring to FIG. 4 which is the circuit diagram of the electronic alarm the power supply 30 is led to the common emitter connection 319 of the transistors 311 and 351 through a switch V. In this invention, the lock 11 of the case is used as the switch V.

The electric circuit shown in FIG. 4 comprises a setting circuit 31 and an operation circuit 35. The setting circuit 31 further comprises a PNPN silicon controlled switch 315, briefly referred as S.C.S., which consists of a PNP transistor 311 and a NPN transistor 312; a capacitor 314 and a resistor 313 to bypass the circuitry to ground which is the metal stud 14 of the case and is referred as G in the circuit diagram. The cathode gate 316 of the S.C.S. 315 is led to the other lock 12 of the case and is referred as setting trigger $T_2$. The cathode 317 of the S.C.S. 315 is connected to ground through a low power lamp 32. The cathode 317 of the S.C.S. 315 is also connected to the anode gate 358 of the S.C.S. 355 of the operation circuit 35 through a pair of gravity switches 331, 332 and a resistor 34. The gravity switches 331 and 332 are used to control the conduction between cathode 317 of S.C.S. 315 and anode gate 358 of S.C.S. 355. Only when the case is put down in a vertical or a horizontal position, will said conduction be OFF. If said conduction is ON, the positive pulse will trigger the S.C.S. 355 of the operation circuit 35 to actuate buzzer 36. The low power lamp 32 is used to sustain the conduction of current to ground when both setting trigger $T_2$ and ground G are touched and a negative pulse is applied to the S.C.S. 315.

The operation circuit 35 consists of a PNP transistor 351 and a NPN transistor forming the S.C.S. 355. A resistor 353 and a capacitor 354 are used to bypass the circuitry to ground. The cathode gate 356 of the S.C.S. 355 is led to the other stud 13 of the case and referred as operation trigger $T_1$. When the operation trigger $T_1$ and ground G are touched simultaneously, the negative pulse fed to cathode gate 356 of the S.C.S. 355 will make the latter become ON and actuate the buzzer 36 to generate an alarm.

From the above description, it is to be noted that the outer appearance is similar to a common attache case. The user, after putting down the case in a horizontal or vertical mode, may touch the lock 12 and the stud 14 by his fingers to set the setting circuit 31. One of the gravity switches 331 and 332 is OFF, therefore the operation circuit 35 will not be actuated. If someone tries to remove the case, the latter will deviate from its vertical or horizontal position. Immediately upon motion, the switches 331 and 332 are ON and the operation circuit 35 will be actuated to generate alarm.

What is claimed is:

1. An attache case comprising:

a case body;

a handle for carrying the case, said handle being connected to said case body through pairs of metal studs;

a lock;

an inside container fixed to the bottom of the case body;

an alarm; and alarm circuitry for generating alarm signals, said alarm circuitry including:

a setting circuit which consists of a first silicon controlled switch formed by a PNP and an NPN transistor, and an operating circuit which consists of a second silicon controlled switch formed by a PNP and an NPN transistor; said first and second silicon controlled switches having a common anode which is connected to a power supply through a switch and the cathodes of each silicon controlled switch being bypassed to ground through a resistor and a capacitor, the cathode gate of the first silicon controlled switch being used as a setting trigger point, and the cathode gate of said second silicon controlled switch being used as an operation trigger point, said alarm being connected between the cathode of said second silicon controlled switch and ground;

means for providing setting signals to said setting trigger point;

and means for providing alarm signals to said operation trigger point.

2. An attache case according to claim 1 wherein said alarm circuitry further comprises a pair of gravity switches in series connection between the cathode of the first silicon controlled switch and the anode gate of the second silicon controlled switch.

3. An attache case according to claim 1, wherein said setting point and operation trigger point are connected to at least one of the metal studs and to the lock, respectively, of the case whereby to set or operate the alarm circuitry from the outside of the case body.

4. An attache case according to claim 1, wherein said inside container comprises a plurality of chambers for containing small articles and an enclosed chamber for the components of the alarm circuitry to be contained therein.

* * * * *